US008410721B2

(12) United States Patent
Busse et al.

(10) Patent No.: US 8,410,721 B2
(45) Date of Patent: Apr. 2, 2013

(54) ELECTRONIC BALLAST AND METHOD FOR OPERATING AT LEAST ONE DISCHARGE LAMP

(75) Inventors: Olaf Busse, Munich (DE); Siegfried Mayer, Moosinning (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 185 days.

(21) Appl. No.: 12/791,022

(22) Filed: Jun. 1, 2010

(65) Prior Publication Data

US 2010/0308740 A1 Dec. 9, 2010

(30) Foreign Application Priority Data

Jun. 4, 2009 (DE) ..... 10 2009 023 884

(51) Int. Cl.
*H05B 41/36* (2006.01)
*G05F 1/00* (2006.01)

(52) U.S. Cl. ..... 315/307; 315/219; 315/308; 315/291; 315/224; 315/247

(58) Field of Classification Search ..... 315/307, 315/219, 308, 291, 360, 224, 247, 127, DIG. 5, 315/DIG. 7
See application file for complete search history.

(56) References Cited

U.S. PATENT DOCUMENTS

| | | | | |
|---|---|---|---|---|
| 5,925,990 | A * | 7/1999 | Crouse et al. | 315/307 |
| 6,333,605 | B1 * | 12/2001 | Grouev et al. | 315/291 |
| 7,098,605 | B2 * | 8/2006 | Oh | 315/291 |
| 7,196,479 | B2 | 3/2007 | Storm | |
| 2004/0080283 | A1 | 4/2004 | Mayer et al. | |

FOREIGN PATENT DOCUMENTS

DE 10349036 A1 5/2005

OTHER PUBLICATIONS

STMicroelectronics, "L6560/L6560A Power Factor Corrector", Jun. 2000, pp. 1-11.*

* cited by examiner

*Primary Examiner* — Daniel D Chang

(57) ABSTRACT

An electronic ballast for operating at least one discharge lamp may include an input for coupling to an input voltage; a load circuit with an output, the load circuit having a bridge circuit; an intermediate circuit capacitor that is coupled to the input of the load circuit; a transformer that is coupled between the input of the ballast and the capacitor, the transformer having a transformer switch; a control apparatus for driving the switch; and a monitoring apparatus for monitoring at least one value correlated with the input voltage, the control apparatus being designed to deactivate the driving of the switch upon detection of a deactivation criterion; and a voltage measuring apparatus for measuring the intermediate circuit voltage, the control apparatus being designed to reactivate the driving of the switch after a deactivation phase when the sum of input and intermediate circuit voltage has dropped below a prescribable threshold value.

10 Claims, 3 Drawing Sheets

ELECTRONIC BALLAST AND METHOD FOR OPERATING AT LEAST ONE DISCHARGE LAMP

CROSS-REFERENCE TO RELATED APPLICATION

This application claims priority to German Patent Application Serial No. 10 2009 023 884.0, which was filed Jun. 4, 2009, and is incorporated herein by reference in its entirety.

TECHNICAL FIELD

Various embodiments relate generally to an electronic ballast for operating at least one discharge lamp Various embodiments further relate to a corresponding method for operating at least one discharge lamp.

BACKGROUND

Electronic ballasts must be protected against overvoltage from the supply network, for example surge pulses. This usually takes place through various components that absorb the excess energy and thus limit the voltage in the ballast. However, these limits do not operate with such steep characteristics that the protection would be perfect. Consequently, such components are often overdimensioned.

In order to avoid the overdimensioning of components, it is known from DE 103 49 036 A1 to turn off power semiconductors, in order in this way to avoid high currents and voltages in and across such components. According to DE 103 49 036 A1, the time derivative of the input voltage is monitored and the transformer switch is turned off when the detected time derivative of the input voltage exceeds a prescribable threshold value. The transformer switch is thereby reliably protected against overvoltage. This has the advantage that the transformer switch need not be so highly dimensioned in terms of its voltage endurance as without this turning off.

The following statements on the prior art relate to FIG. 2 of the abovementioned DE 103 49 036 A1. However, in order to simplify comprehension, the same reference symbols have been used for the electronic ballast illustrated schematically in FIG. 1 of the various embodiments to the extent that the circuit structure corresponds to that from DE 103 49 036 A1.

A disadvantage of this known mode of procedure consists, however, in that the high voltage across the capacitor of the network filter, which is connected upstream of the transformer, that is to say across the capacitor C10, is stored for a certain time, since power is no longer drawn owing to the turning off of the transformer switch S20. The turning off of the transformer switch S20 consequently leads to the fact that the capacitor C30 is no longer recharged. The load circuit supplied from the capacitor C30 is operated further until it is turned off owing to undervoltage. It is now necessary to wait until the capacitor C10 is discharged via parasitic resistances down to an uncritical value before the transformer switch S20 can be turned on again. This limit value can be 400 V, for example. If it is detected that this 400 V threshold has been undershot, the ballast is restarted entirely. Owing to this mode of procedure, a period of approximately 1 s elapses from the turning off of the load circuit until the capacitor C10 is sufficiently discharged. The restarting of the electronic ballast lasts a further 1.2 s, and so the user has no light over a period of approximately 2.2 s—in the present example.

SUMMARY

An electronic ballast for operating at least one discharge lamp may include an input for coupling to an input voltage; a load circuit with an output, the load circuit having a bridge circuit; an intermediate circuit capacitor that is coupled to the input of the load circuit; a transformer that is coupled between the input of the ballast and the capacitor, the transformer having a transformer switch; a control apparatus for driving the switch; and a monitoring apparatus for monitoring at least one value correlated with the input voltage, the control apparatus being designed to deactivate the driving of the switch upon detection of a deactivation criterion; and a voltage measuring apparatus for measuring the intermediate circuit voltage, the control apparatus being designed to reactivate the driving of the switch after a deactivation phase when the sum of input and intermediate circuit voltage has dropped below a prescribable threshold value.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide an electronic ballast for operating at least one discharge lamp, having an input with a first and a second input connection for coupling to an input voltage; a load circuit with an output that includes a first and a second output connection for coupling to the at least one discharge lamp, the load circuit including a bridge circuit with at least a first and a second bridge switch, an intermediate circuit capacitor that is coupled to the input of the load circuit, the voltage dropping across the intermediate circuit capacitor during operation representing the intermediate circuit voltage, a transformer that is coupled between the input of the electronic ballast and the intermediate circuit capacitor, the transformer including at least one transformer switch, a control apparatus for driving the transformer switch and at least the first and the second bridge switch, and a monitoring apparatus for monitoring at least one value correlated with the input voltage, the monitoring apparatus being coupled to the control apparatus, and the control apparatus being designed to deactivate the driving of the transformer switch upon detection of a deactivation criterion. Various embodiments further provide a corresponding method for operating at least one discharge lamp.

Various embodiments develop the electronic ballast mentioned at the beginning and the method mentioned at the beginning in such a way that the period in which the user has no light after the occurrence of a surge pulse is shorter than for the known mode of procedure.

Figure 2:
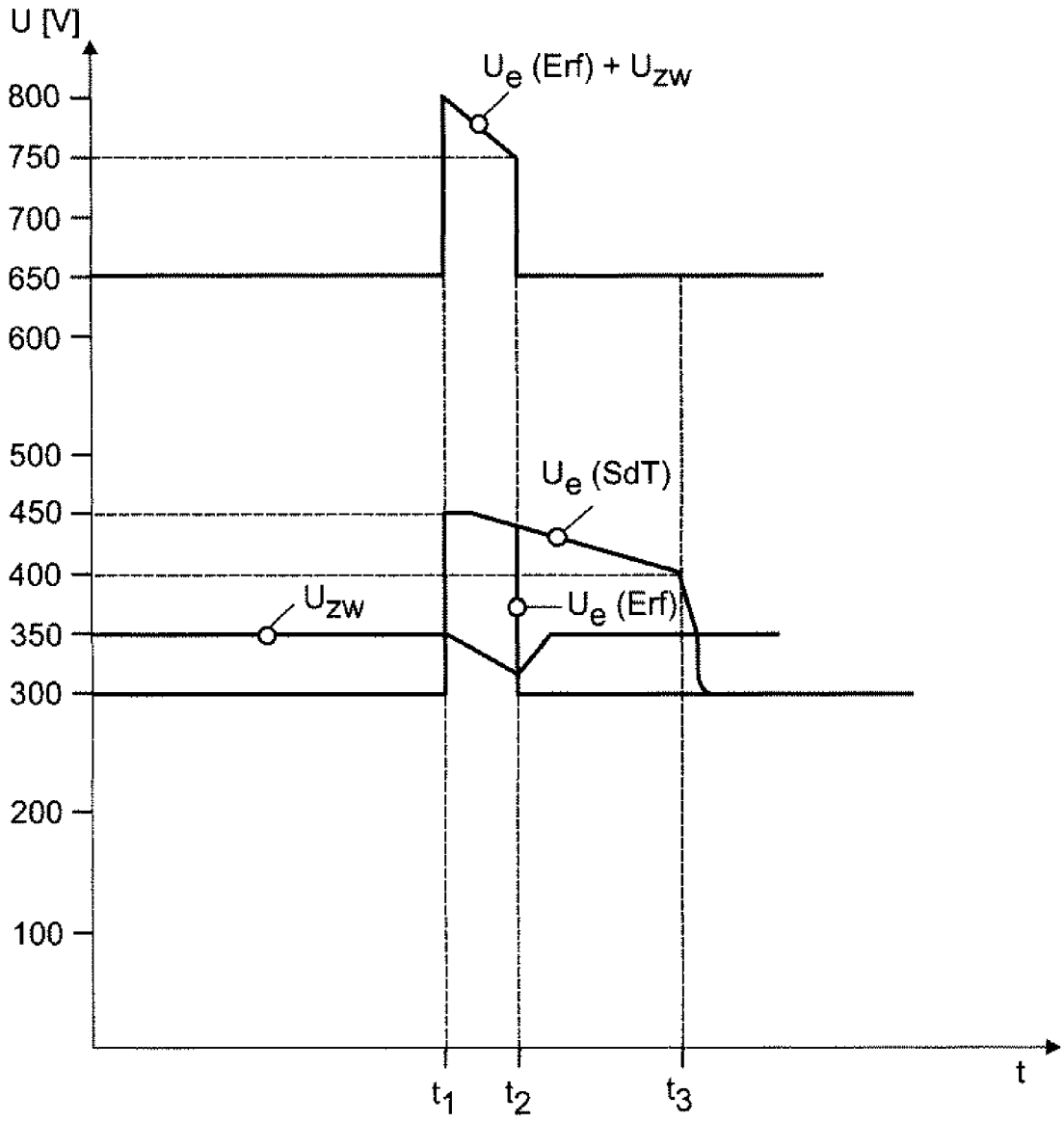
FIG. 2 shows the time profile of the input voltage, the intermediate circuit voltage, the sum of input and intermediate circuit voltages in the case of the mode of procedure according to the prior art and in accordance with various embodiments.

Various embodiments are based on the finding that the switch S20 from FIG. 2 of DE 103 49 036 A1 is typically to be dimensioned in relation to the sum of the voltages across the capacitors C20 and C30, the voltage across the capacitor C20 corresponding to the voltage across the capacitor C10, that is to say to the input voltage in the present case, and the voltage C30 corresponds to the intermediate circuit voltage. Damage to the switch S20 can therefore be excluded when the sum of input voltage and intermediate circuit voltage is below the threshold value for which the switch S20 has been dimensioned. According to various embodiments, it is therefore not monitored whether the input voltage undershoots a prescribable threshold value, but whether the sum of input voltage and intermediate circuit voltage undershoots a prescribable threshold value.

This opens up the possibility of operating the bridge circuit further after turning off the switch S20, in order thereby to discharge the capacitor C30 as speedily as possible. This leads to a rapid reduction in the intermediate circuit voltage such that the transformer switch S20 can, as a result, already be turned on again although the input voltage is still above the threshold value known from the prior art.

Consequently, in most cases it is possible to avoid extinction of the discharge lamp completely. In the remaining cases, what happens mostly is only a short extinction of the discharge lamp of the order of magnitude of approximately 10 ms since, because of the short off time, cold starting of the discharge lamp frequently suffices for putting the latter into operation again.

The deactivation of the transformer switch on the basis of the detection of at least one deactivation criterion can take place when the value of the input voltage has exceeded a second prescribable threshold value, and/or the value of the sum of input voltage and intermediate circuit voltage has exceeded a third prescribable threshold value, and/or the time derivative of the input voltage has exceeded a fourth prescribable threshold value. In the last-named case, the control apparatus comprises an apparatus for determining the time derivative of the input voltage. One or more of these measures ensure that the transformer switch S20 is reliably protected against overvoltages.

In various embodiments, the control apparatus is designed to deactivate the driving at least of the first and the second bridge switch when the value of the intermediate circuit voltage has dropped below a fifth prescribable threshold value. However, it may be provided in this context that the control apparatus is designed to keep the driving at least of the first and the second bridge switch active during the deactivation phase of the driving of the transformer switch until the value of the intermediate circuit voltage has dropped below the fifth prescribable threshold value. As already mentioned above, the effect of this is that the capacitor C30 is quickly discharged, as a result of which the sum of input and intermediate circuit voltages drops speedily such that this sum value drops as early as possible below the limit value typical for the switch S20.

In accordance with various embodiments, the electronic ballast may further include a time measuring apparatus that is coupled to the control apparatus, the control apparatus being designed to carry out cold starting of the lamp after a first prescribable period after the beginning of a deactivation phase at least of the first and the second bridge switch, and after the sum of input and intermediate circuit voltages has dropped below the first prescribable threshold value. Consequently, if the sum of input and intermediate circuit voltages undershoots the threshold value provided, the period in which the discharge lamp is not supplied with energy can be minimized by carrying out cold starting of the lamp. By contrast, in the prior art the period in which the bridge circuit, and thus the discharge lamp, were deactivated was generally so long that it was not possible to consider cold starting of the lamp. In the case of the mode of procedure in accordance with various embodiments, by contrast, in the overwhelming number of cases in which turning off the bridge circuit comes about at all, the justified hope arises that just cold starting of the lamp is enough to make it possible for the discharge lamp to be started up again.

In cases where the cold starting of the lamp is nevertheless unsuccessful, the following can be provided: The electronic ballast then further includes a memory apparatus for storing values of the input voltage, the control apparatus being designed to carry out restarting of the lamp when the cold starting of the lamp has not led to ignition of the discharge lamp, and when at least one of the deactivation criteria for the transformer switch has been detected within a prescribable period before the failed cold starting of the lamp. This check ensures that turning off is not a consequence of a defective discharge lamp. Thus, the lamp is started only when it is justified to hope that the discharge lamp can be brought into operation again, since the latter is still intact.

If restarting the lamp should also not lead to success, it is to be assumed that the discharge lamp is defective. The control apparatus is therefore designed to deactivate the driving at least of the first and the second bridge switch when the cold starting of the lamp has not led to ignition of the discharge lamp and when none of the deactivation criteria has been detected within the second prescribable period before the failed cold starting of the lamp.

The transformer may be an SEPIC (Single Ended Primary Inductance Converter).

The embodiments presented with reference to the electronic ballast, and the advantages thereof, are valid correspondingly, to the extent they can be applied for the method in accordance with various embodiments.

Figure 1:
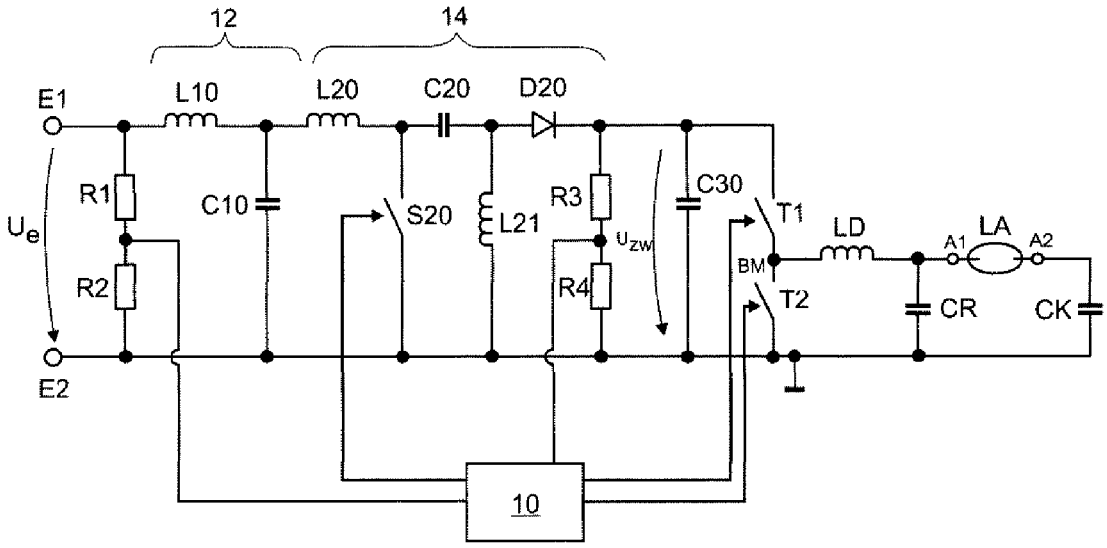
FIG. 1 shows a schematic of an embodiment of an electronic ballast.

FIG. 1 is a schematic of an embodiment of an electronic ballast. The latter has an input with a first E1 and a second input connection E2, between which an input voltage Ue is present. The input voltage Ue is a direct voltage and can be produced from an AC supply voltage by using a rectifier and a smoothing capacitor (not illustrated). A voltage divider with ohmic resistors R1, R2 is provided for measuring the input voltage Ue. For the purpose of voltage measurement, the tap of said voltage divider is coupled to a control apparatus 10. Via the tap of the voltage divider R1, R2, the control apparatus 10 can also monitor the time derivative of the input voltage Ue, e.g. detect whether the latter exceeds a prescribable threshold value. For this purpose, the control apparatus 10 has an apparatus for determining the time derivative of the input voltage.

Downstream of the voltage divider R1, R2 is a network filter 12 that in this case includes an inductor L10 and a capacitor C10. Connected to the network filter 12 is an SEPIC transformer 14 that includes an inductor L20, a transformer switch S20, a capacitor C20, an inductor L21 and a diode D20. The intermediate circuit voltage $U_{zw}$ is provided at the output of the SEPIC transformer 14. The intermediate circuit voltage is measured by using the voltage divider R3, R4. For this purpose, the tap of the voltage divider R3, R4 is coupled to the control apparatus 10. The intermediate circuit voltage $U_{zw}$ is provided by using a capacitor C30 of a half bridge circuit that includes a first T1 and a second bridge switch T2. A lamp inductor LD is coupled between the bridge center point BM and a first output A1 of the circuit arrangement. A resonant capacitor $C_R$ is coupled between the output A1 and the reference potential. The discharge lamp La is coupled between the first output connection A1 and a second output connection A2, the latter likewise being coupled to the reference potential via a coupling capacitor CK.

The control apparatus 10 is coupled to the switch S20 and the switches T1, T2 in order to drive them. The control apparatus 10 is designed to determine different variables of the electronic ballast illustrated in FIG. 1, to evaluate them and compare them against threshold values. For this purpose, the control apparatus 10 can include a time measuring apparatus and/or a memory apparatus for storing values of the input voltage Ue, or be coupled to such apparatuses. This is explained yet more clearly further below with reference to FIGS. 2 and 3.

FIG. 2 shows the time profile of the input voltage, the intermediate circuit voltage and the sum of input and intermediate circuit voltages in the case of the mode of procedure according to the prior art and in accordance with various embodiments.

Considering firstly the time profile of the input voltage Ue, it is found that it is at approximately 300 V until it rises at the instant $t_1$ to 450 V as a consequence of a surge pulse. In the prior art (SdT), it is now ensured by monitoring that the input voltage Ue(SdT) has dropped below 400 V before the half bridge S1, S2, and thus the discharge lamp La are restarted. This is the case at the instant $t_3$, the input voltage Ue(SdT) dropping quickly to the initial value of 300 V after starting of the half bridge S1, S2 as a consequence of the energy drawn from the capacitor C10 for this.

According to various embodiments (Erf), however, the sum of input voltage Ue(Erf) and the intermediate circuit voltage $U_{zw}$ is monitored. Because the bridge circuit is operated further after the occurrence of a surge pulse at the instant $t_1$, the intermediate circuit voltage $U_{zw}$ drops after the instant $t_1$ (whereas it would have remained virtually constant in the prior art after the instant $t_1$). According to various embodiments, the transformer switch S20 is only reactivated when the sum of input voltage Ue(Erf) and intermediate circuit voltage $U_{zw}$ has undershot a prescribable threshold, in the present case 750 V. This is already the case at the instant $t_2$.

In other words, in the prior art the period $t_3$ minus $t_1$ elapses until the transformer switch is released after the occurrence of a surge pulse, whereas in accordance with various embodiments only the period $t_2$ minus $t_1$ passes. The period $t_2$ minus $t_1$ is short enough in most cases for the discharge lamp La not to be extinguished at all, or it is at least possible to perform a successful cold start of the lamp.

Figure 3:
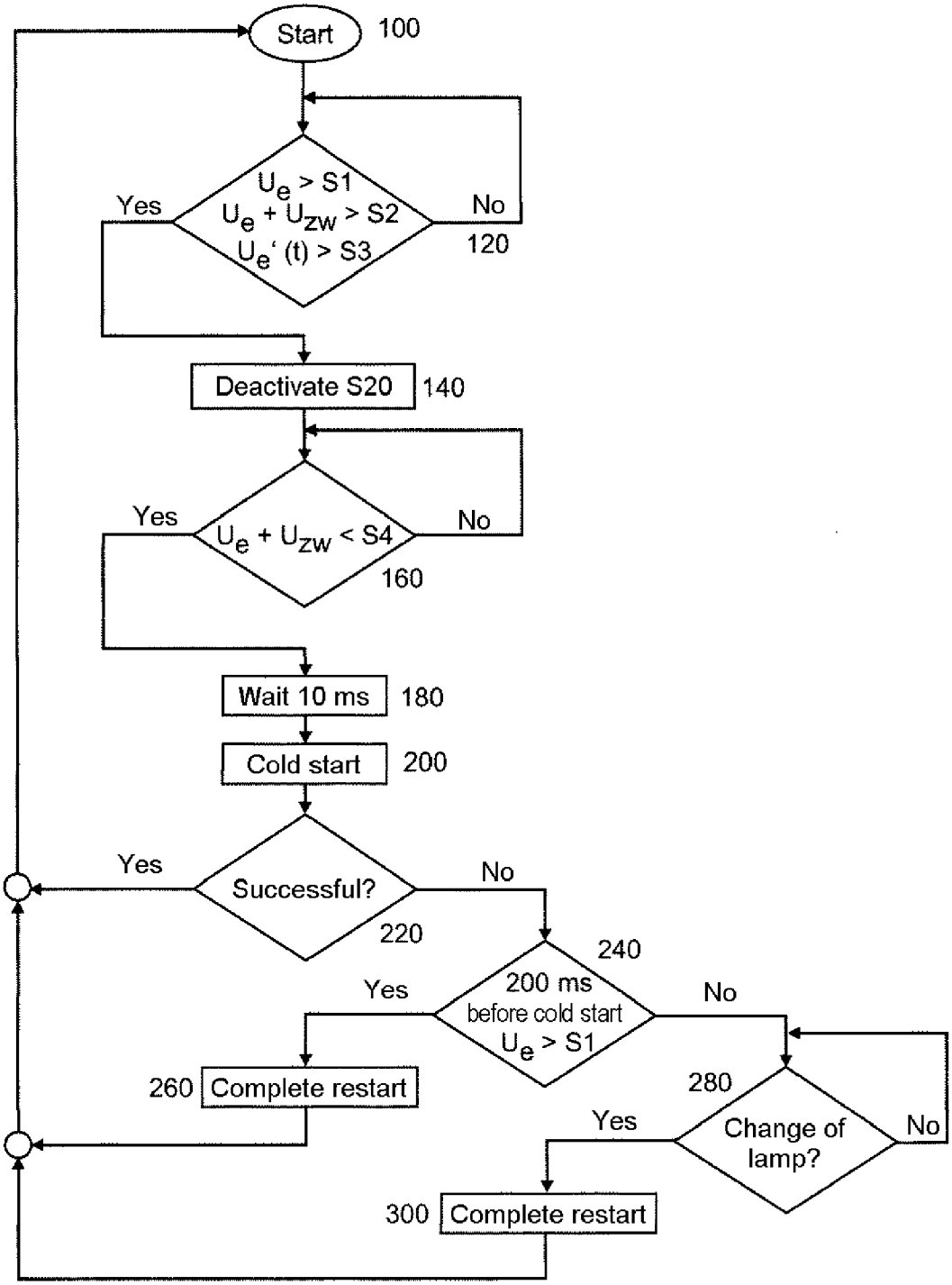
FIG. 3 shows a method in accordance with an embodiment.

FIG. 3 is a schematic of the course of an embodiment of a method. Said method starts in step 100. Subsequently, a continuous check is made in step 120 as to whether the input voltage Ue exceeds a threshold value S1, and/or the sum of input voltage Ue and intermediate circuit voltage $U_{zw}$ exceeds a second threshold value S2, and/or the time derivative U'e(t) exceeds a third threshold value S3. This is continued until it is detected that the respective threshold value has been exceeded. Whereupon, the transformer switch S20 is deactivated in step 140. Subsequently, a continuous check is made in step 160 as to whether the sum of input voltage Ue and intermediate circuit voltage $U_{zw}$ undershoots a threshold value S4. If this is the case, a pause of 10 ms is firstly made in step 180, and subsequently cold starting of the lamp is carried out in step 200.

If this is successful (see step 220), the electronic ballast is once again operating as normal, and a jump is made back to the start of the method.

In the case when cold starting of the lamp was not successful (step 220), a check is made in step 240 as to whether at least one of the criteria of step 120 was fulfilled 200 ms before the cold start was carried out. If this was the case, the lamp is completely restarted in step 260 and there is subsequently a jump back to the start of the method. If, by contrast, it is detected in step 240 that none of the conditions of step 120 was fulfilled, a pause is made in step 280 for a change of lamp. It is only after the lamp has been changed that the lamp is completely restarted in step 300 and there is subsequently a jump back to the start of the method.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An electronic ballast for operating at least one discharge lamp, the electronic ballast comprising:

an input with a first and a second input connection for coupling to an input voltage;

a load circuit with an output that comprises a first and a second output connection for coupling to the at least one discharge lamp, the load circuit comprising a bridge circuit with at least a first and a second bridge switch;

an intermediate circuit capacitor that is coupled to the input of the load circuit, the voltage dropping across the intermediate Circuit capacitor during operation representing the intermediate circuit voltage;

a transformer that is coupled between the input of the electronic ballast and the intermediate circuit capacitor, the transformer comprising at least one transformer switch;

a control apparatus for driving the transformer switch and at least the first and the second bridge switch; and a monitoring apparatus for monitoring at least one value correlated with the input voltage, the monitoring apparatus being coupled to the control apparatus, and the control apparatus being designed to deactivate the driving of the transformer switch upon detection of a deactivation criterion; and a voltage measuring apparatus for measuring the intermediate circuit voltage, the voltage measuring apparatus being coupled to the control apparatus, the control apparatus being designed to reactivate the driving of the transformer switch after a deactivation phase when the sum of input and intermediate circuit voltage has dropped below a first prescribable threshold value, wherein the transformer is an single-ended primary-inductor converter (SEPIC) transformer.

2. The electronic ballast as claimed in claim 1, wherein the monitoring apparatus is designed to monitor the input voltage, the deactivation criterion being present when the value of the input voltage has exceeded a second prescribable threshold value.

3. The electronic ballast as claimed in claim 1, wherein the monitoring apparatus is designed to monitor the sum of input voltage and intermediate circuit voltage, the deactivation criterion being present when the value of the sum of input voltage and intermediate circuit voltage has exceeded a third prescribable threshold value.

4. The electronic ballast as claimed in claim 1, wherein the control apparatus comprises an apparatus for determining the time derivative of the input voltage, the control apparatus being designed to monitor the time derivative of the input voltage, the deactivation criterion being present when the value of the time derivative of the input voltage has exceeded a fourth prescribable threshold value.

5. The electronic ballast as claimed in claim 1, wherein the control apparatus is designed to deactivate the driving at least of the first and the second bridge switch when the value of the intermediate circuit voltage has dropped below a fifth prescribable threshold value.

6. The electronic ballast as claimed in claim 5, wherein the control apparatus is designed to keep the driving at least of the first and the second bridge switch active during the deactivation phase of the driving of the transformer switch until the value of the intermediate circuit voltage has dropped below the fifth prescribable threshold value.

7. The electronic ballast as claimed in claim 1, further comprising: a time measuring apparatus that is coupled to the control apparatus, the control apparatus being designed to carry out cold starting of the lamp after a first prescribable period after the beginning of a deactivation phase at least of the first and the second bridge switch, and after the sum of input and intermediate circuit voltages has dropped below the first prescribable threshold value.

8. The electronic ballast as claimed in claim 7, further comprising: a memory apparatus configured to store values of the input voltage, the control apparatus being designed to carry out restarting of the lamp when the cold starting of the lamp has not led to ignition of the discharge lamp, and when at least one of the deactivation criteria for the transformer switch has been detected within a second prescribable period before the failed cold starting of the lamp.

9. The electronic ballast as claimed in claim 7, wherein the control apparatus is designed to deactivate the driving at least of the first and the second bridge switch when the cold starting of the lamp has not led to ignition of the discharge lamp and when none of the deactivation criteria has been detected within the second prescribable period before the failed cold starting of the lamp.

10. A method for operating at least one discharge lamp on an electronic ballast, the electronic ballast comprising:

an input with a first and a second input connection for coupling to an input voltage;

a load circuit with an output that comprises a first and a second output connection for coupling to the at least one discharge lamp, the load circuit comprising a bridge circuit with at least a first and a second bridge switch;

an intermediate circuit capacitor that is coupled to the input of the load circuit, the voltage present at the intermediate circuit capacitor representing the intermediate circuit voltage;

a transformer that is coupled between the input of the electronic ballast and the intermediate circuit capacitor, the transformer comprising at least one transformer switch;

a control apparatus for driving the transformer switch and at least the first and the second bridge switch; and a monitoring apparatus configured to monitor at least one value correlated with the input voltage, the monitoring apparatus being coupled to the control apparatus, and the control apparatus being designed to deactivate the driving of the transformer switch upon detection of a deactivation criterion;

wherein the transformer is an single-ended primary-inductor converter (SEPIC) transformer;

the method comprising:

a) measuring the intermediate circuit voltage;

b) determining the sum of input and intermediate circuit voltages; and c) activating the driving of the transformer switch if the sum of input and intermediate circuit voltages has dropped below a first prescribable threshold value after a deactivation phase of the transformer switch.

* * * * *